US007611336B2

(12) United States Patent
Ikuta

(10) Patent No.: US 7,611,336 B2
(45) Date of Patent: Nov. 3, 2009

(54) PUMP AND ENGAGEABLE STRUCTURE OF OPERATION ROD THEREOF

(75) Inventor: Kazumasa Ikuta, Yokohama (JP)

(73) Assignee: Bay City Service Co., Ltd., Kanagawa (JP)

( * ) Notice: Subject to any disclaimer, the term of this patent is extended or adjusted under 35 U.S.C. 154(b) by 703 days.

(21) Appl. No.: 11/346,217

(22) Filed: Feb. 3, 2006

(65) Prior Publication Data

US 2006/0123780 A1 Jun. 15, 2006

(30) Foreign Application Priority Data

Jun. 28, 2005 (JP) ..... 2005-188674

(51) Int. Cl.
*F04B 49/00* (2006.01)
*A21B 5/08* (2006.01)
*A47J 37/06* (2006.01)

(52) U.S. Cl. ..... 417/223; 417/15; 417/465; 99/355; 99/483

(58) Field of Classification Search ..... 417/15, 417/214, 223, 462, 464, 465; 99/348, 352, 99/355, 483

See application file for complete search history.

(56) References Cited

U.S. PATENT DOCUMENTS 6,513,421 B2 * 2/2003 Ikuta ..... 99/348
2005/0244289 A1 * 11/2005 Ikuta ..... 417/415
2006/0275159 A1 * 12/2006 Ikuta ..... 417/415

FOREIGN PATENT DOCUMENTS

JP 2004-188385 8/2004

* cited by examiner

*Primary Examiner*—Devon C Kramer
*Assistant Examiner*—Patrick Hamo
(74) *Attorney, Agent, or Firm*—Ronald E. Greigg

(57) ABSTRACT

The engageable structure of the operation rod in the pump includes a valve member having an outer sleeve as an outer valve, an inner sleeve as an inner valve installing in the outer sleeve rotatably and a pushing operation body with a sliding part installed in the inner sleeve and with a driven operation rod; a drive source; and a driving operation rod moves horizontally due to guiding by a supporting member arid force of the drive source, and a catching part of the valve member engages with a connection-supporting device which is attached to the driving operation rod when the driven operation rod of the valve member and driving operation rod of the drive source are connected. The connection-supporting device is supported pivotably at a cantilevered state to the driving operation rod at a biasing state by a spring member in the specified direction, having a vertical plate installed consecutively in a tip end portion of a pivoted plate for attachment and a locking part installed consecutively in a front surface of the vertical plate at a projecting state. Therefore, the valve member can be removed easily from the driving operation rod.

8 Claims, 18 Drawing Sheets

PUMP AND ENGAGEABLE STRUCTURE OF OPERATION ROD THEREOF

CROSS REFERENCE TO RELATED APPLICATIONS

This application is based on Japanese Patent Application 2005-188674 filed on Jun. 28, 2005, upon which priority is claimed.

FIELD OF THE INVENTION

The present invention relates to a pump and an engageable structure of an operation rod of the pump, capable of discharging fluid at a determinate quantity.

BACKGROUND OF THE INVENTION

The reference document 1 discloses an engageable structure (clamp) of an operation rod (FIGS. 7 and 8), connecting a driven operation rod of a valve member and driving operation rod of a side of a drive source and comprising of a valve member including an outer sleeve as an outer valve having a suction hole and a discharge hole; an inner sleeve as an inner valve installed into the outer sleeve rotatably and a pushing operation body having an driven operation rod and a sliding part thereof installed in the inner sleeve; and a drive source; a driving operation rod which moves by force of the drive source and moves horizontally by introducing the supporting member.

For the engageable structure of the operation rod, the valve member is engaged horizontally against the clamp when it is connected. On the other hand, when the valve member is removed, the valve member cannot be removed from the clamp horizontally at the connecting state so that it makes the fixation member as a driving operation rod to go forward at a position which the piston clamp opens through the pair of the upper and lower opening member. In addition, the valve member is removed horizontally when the piston clamp opens. Therefore, the clamp disclosed in the reference documents has a method for pushing openably and electrically and removing by hand so to speak.

In other words, the engageable structure of the operation rod described in the reference document 1 is composed of the elements of (a) to (g) as follows:

(a) the fixation member fixed to means for going the piston of the valve member forward and back;

(b) the pair of the upper and lower piston clamps provided pivotably at the fixation member having the rack provided at the upper surface thereof;

(c) the pair of the upper and lower backward elastic bodies biasing the piston clamps in the closing direction directing to the front;

(d) the holding part formed at the both tip portions of the piston clamps, holding on the back ends of the piston shaft as the driven operation rod detachably;

(e) the taper formed at the facing surface of the tip portion of the holding part;

(f) one elastic body installed into the piston clamps so as to contact the back ends of the piston shaft when the piston shaft engages with the piston clamp; and (g) the pair of the upper and lower opening parts having tapers which introduce upward so as to open the taper of the tip portion of the holding part.

When the valve member is removed in the above-mentioned structure, the fixation member as the driving operation rod is made to go forward by driving force of the drive motor.

When the fixation member with the rack goes forward, the piston clamp (corresponding to "connection-supporting device" of the present invention) which is formed at the tip portion of the fixation member goes forward obviously.

After that, according to the control signal from the control part, it makes the fixation member to go forward at a removing point of the valve member. Then, the catching part of the driven operation rod (piston shaft) which is set at the predetermined position presses the elastic body in the piston clamp, and the tip portion of the piston clamp opens since the holding part (tip taper) of the piston clamps is introduced to the taper of the opening part. Therefore, the valve member can be removed from the piston clamp by hand.

As is clear from the above-mentioned composition, since the piston clamp, which is disclosed in the reference document 1, corresponding to "connection-supporting device" of the present invention is sandwiching (holding) device which is formed in the shape of the pinch for washing for example, its structure is complex (See FIG. 8 in the reference document). In addition, when the valve member is removed, it has to go forward at the removing point and open the piston clamp compulsorily through the pair of the opening member. There are great hopes at the present day that the new engageable structure of the operation rod, capable of removing the valve member easily, is developed.

SUMMARY OF THE INVENTION

Accordingly, it is an object of the present invention to provide an engageable structure of an operation rod of the pump that can remove a valve member from a driving operation rod easily. It is another object of the present invention to provide an engageable structure of an operation rod of the pump that can reduce the number of the parts which structures and the cost. It is further object of the present invention to provide an engageable structure of an operation rod of the pump that is available for soups with substance and similar fluid. It is further object of the present invention to provide a pump that includes the main parts of the present invention.

The present invention is understood to encompass embodiments which include all or only a portion of the above objects, features and advantages which, unless recited in claims defining the invention, are understood not to limit interpretation of such claims. The above and other objects, features and advantages of the present invention will become apparent from the following description read in conjunction with the accompanying drawings, in which like reference numerals designate the same elements.

It is to be expressly understood, however, that the drawings are for the purpose of illustration and description only, and are not intended as a definition of the limits of the invention.

BRIEF DESCRIPTION OF THE DRAWINGS

FIG. 1 is a schematic sectional explanation view of a pump (an inner sleeve and pushing operation body are positioned at an original position, for example);

FIG. 2 is an explanation view (when the clutch engages with the driving gear) of a main part (drive source, clutch mechanism);

FIG. 3 is a schematic explanation view of an inner sleeve, pushing operation body, driven gear, screwing body and the like;

FIG. 4 is an explanation view of an example of a pushing operation body;

FIG. 5 is a schematic longitudinal sectional view of a rear end portion of a lengthwise sleeve body;

FIG. 6 is a schematic explanation view which assembles a driven gear and inner sleeve integrally;

FIG. 7 is a perspective view showing the way in which the an engageable structure is installed into the rear end portion of the inner sleeve;

FIG. 8 is a schematic explanation view (front view) of the main parts of the present invention;

FIG. 9 is a schematic explanation view (plan view) of the main parts of the present invention;

FIG. 10 is a perspective view of a connection-supporting device;

FIG. 11 is a cross sectional view by a line taken along a line 11-11 in FIG. 10;

FIG. 12 is a schematic explanation view when a valve member is connected;

FIG. 13 is a schematic explanation view when a valve member is removed;

FIG. 14 is a schematic sectional explanation view for the effect of a pump (an opening connects with a discharge hole when an inner sleeve rotates);

FIG. 15 is a schematic sectional explanation view for the effect of a pump (a pushing operation body goes forward);

FIG. 16 is a schematic sectional explanation view as the as FIG. 1;

FIG. 17 is a schematic explanation view (front view) of the main part; and

FIG. 18 is a schematic explanation view (plan view) of the main part.

DETAILED DESCRIPTION OF THE PREFERRED EMBODIMENTS

Figure 1:
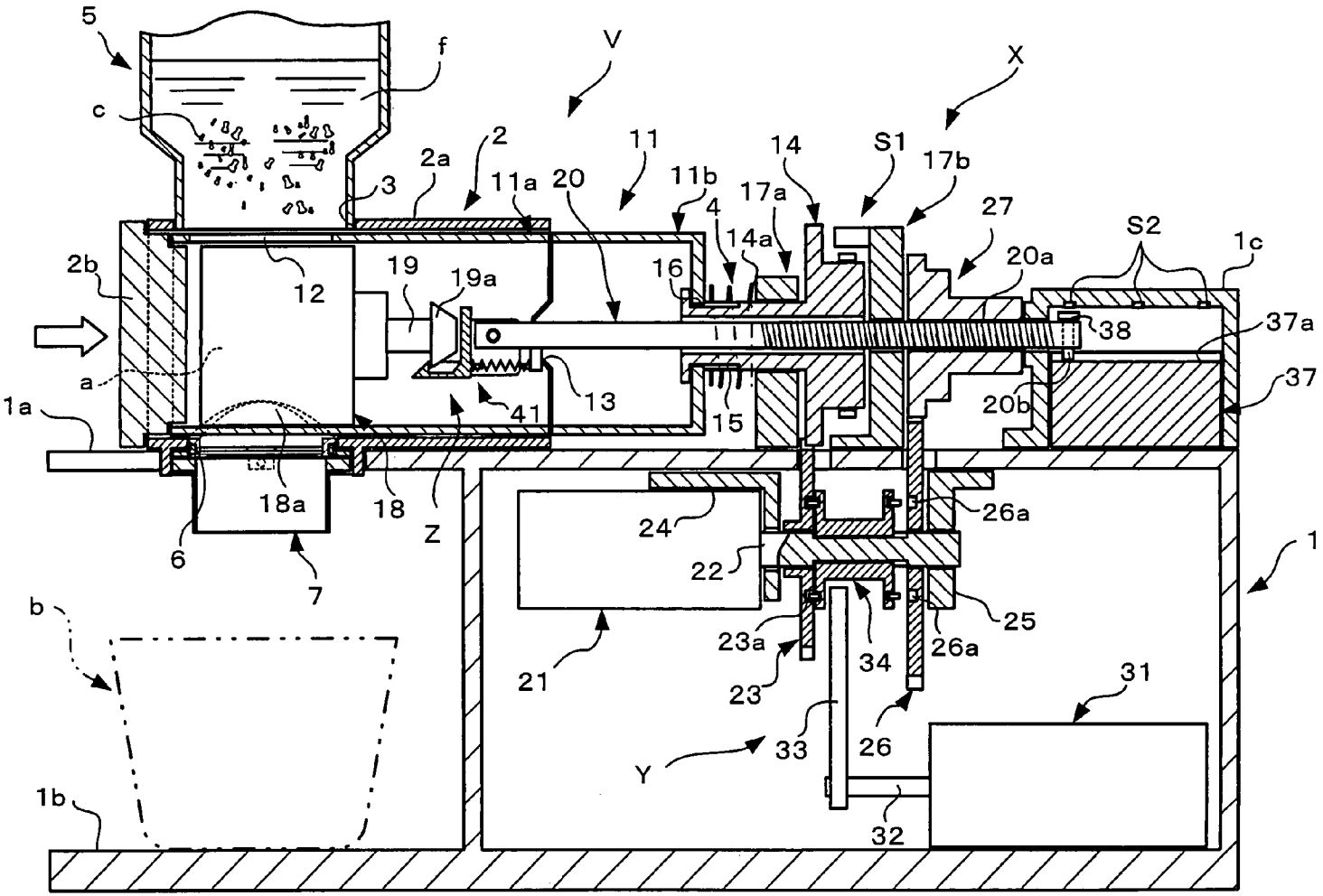
FIGS. 1 to 15 are examples of the present invention and pumps of the applicable pump of the present invention.

First of all, after the pump as a prerequisite is explained in particular, the composition of the present invention is explained in particular. FIGS. 1 to 15 show an example of a pump that is available for soups with substance and similar fluid.

(1) Basic Constructional Element

The mark of X is a pump for supplying fluid. An outer sleeve, inner sleeve and the like of the pump X are arranged at an upper surface of an upper horizontal plate 1*a* of a fixed member 1 in a horizontal direction. In addition, a plurality of openings including opening for a valve member, opening for a driving gear, opening for a transmission gear and the like or cutting parts are formed at the upper horizontal plate 1*a* accordingly. In addition, one drive source (drive motor) 21 for the pump X is arranged at a lower surface of the upper horizontal plate 1*a* through a motor attachment plate in a horizontal direction. In addition, a mounting frame 1*c,* which is formed in the shape of a case, is provided at the rear end part at the side of the upper surface of the upper horizontal plate 1*a,* and a through hole of the mounting frame 1*c* introduces the rear end portion of a driving operation rod 20 which catches an operation rod (hereinafter called a driven operation rod 19) of a pushing operation body 18. The driven operation rod 19 and driving operation rod 20 can be connected detachably by the engageable structure Z of the operation rod which is described below.

Additionally, a plurality of means S2 for detecting the position for the pushing operation body 18 are arranged at the mounting frame 1*c* at the required space. In addition, an antirotation device 37 for the pushing operation body 18 is installed into the mounting frame 1*c,* and an engaged part 37*a* is formed at an upper surface of the antirotation device 37 and engages with an engaging part 20*b* which is formed at the driving operation rod 20. The engaging part 20*b* of the driving operation rod 20 is defined as a vertical catching piece (catching pin, for example) which crosses to the driving operation rod 20, and an engaged part 37*a* is a guide groove which is formed in the shape of a lengthwise groove. In this embodiment, an index or a magnet device 38*b* for the detecting means S2 is formed at an upper projected end portion of the engaging part 20*b* at a horizontal state. Therefore, the pushing operation body 18 can move forward and backward through means for protecting the rotation, means comprised of the engaging part 20*b* of the driving operation rod 20 and the engaged part 37*a* of the fixed member 1.

Furthermore, the fixed member 1 includes a lower horizontal plate 1*b* to face to the upper horizontal plate 1*a,* means 31 for driving (solenoid) composed the clutch mechanism Y is arranged at the upper surface of the lower horizontal plate 1*b* horizontally. The drive source 21 for the pump X and clutch mechanism Y as the main member of the pump X are explained. The composition of the present invention is described later (in particular, FIGS. 10, 11 and the like).

(2) Outer Sleeve of the Pump X

The outer sleeve 2 (outer valve) is comprised of a sleeve body 2*a,* forming in the shape of a lengthwise sleeve and having openings provided at both ends thereof; and a head 2*b* which joints with the opening of one end portion of the sleeve body 2*a*.

Now the composition of the sleeve body 2*a* is explained here. The reference numeral 3 is a suction hole which is formed at an upper surface of one end portion thereof, and a hopper 5 is attached to the suction hole 3 detachably. The reference numeral 6 is a discharge hole which is formed at a lower surface of one end portion thereof, arid the discharge hole 6 faces to the suction hole 3 and is attached a sealing member 7 having a discharging nozzle threadably. In addition, the outer sleeve 2 with a head 2*b* has a predetermined length, and it is fixed detachably to the upper horizontal plate 1*a*. In this embodiment, the suction hole 3 and discharge hole 6 has a single number of element. In addition, the suction hole 3 and discharge hole 6 are formed in the shape of a circle for example.

(3) Inner Sleeve of Pump X

The inner sleeve 11 (inner valve) in this embodiment is defined as a sleeve body with a fixed quantity, and it rotates by driving force of one drive source 21, and takes fluid fat a specified quantity therein from the hopper 5 through the suction hole 3 and discharges it through the discharge hole 6.

Therefore, the inner sleeve 11 brings out the function of the inner valve against the outer sleeve 2 corresponding to the valve body. Therefore, one opening 12 is formed at the tip portion (left side in the figure) of the inner sleeve 11, the opening 12 communicating with the suction hole 3 of the outer sleeve 2 and discharge hole 6 selectively.

And now, the inner sleeve 11 in this embodiment includes a lengthwise sleeve body 11*a* and a back end portion 11*b,* capable of engaging with the lengthwise sleeve body, rapping a connection-supporting device and forming in the shape of a shorten sleeve. The back end portion 11*b* always biases in the engagement direction of the back end portion of the lengthwise sleeve body 11*a* by an elastic member 4 which is provided at a side of the drive source.

In addition, the valve member V in this embodiment is comprised of the outer sleeve 2 as an outer valve, having the suction hole and discharge hole; the inner sleeve 11 as an inner valve, installing into the outer sleeve rotatably; and the pushing operation body 18, having a sliding part 18*a* which is assembled in the inner sleeve and having a driven operation rod 19. In addition, the valve member V is connected easily after the valve member V is pushed horizontally against a taper 46*b* of a locking part 46 of the connection-supporting device 41 when the operation rods 19, 20 are connected. On the other hand, the engagement of the valve member V and connection-supporting device 41 is broken up easily after the valve member V is held up a little for example when the valve member V is removed.

Figure 5:
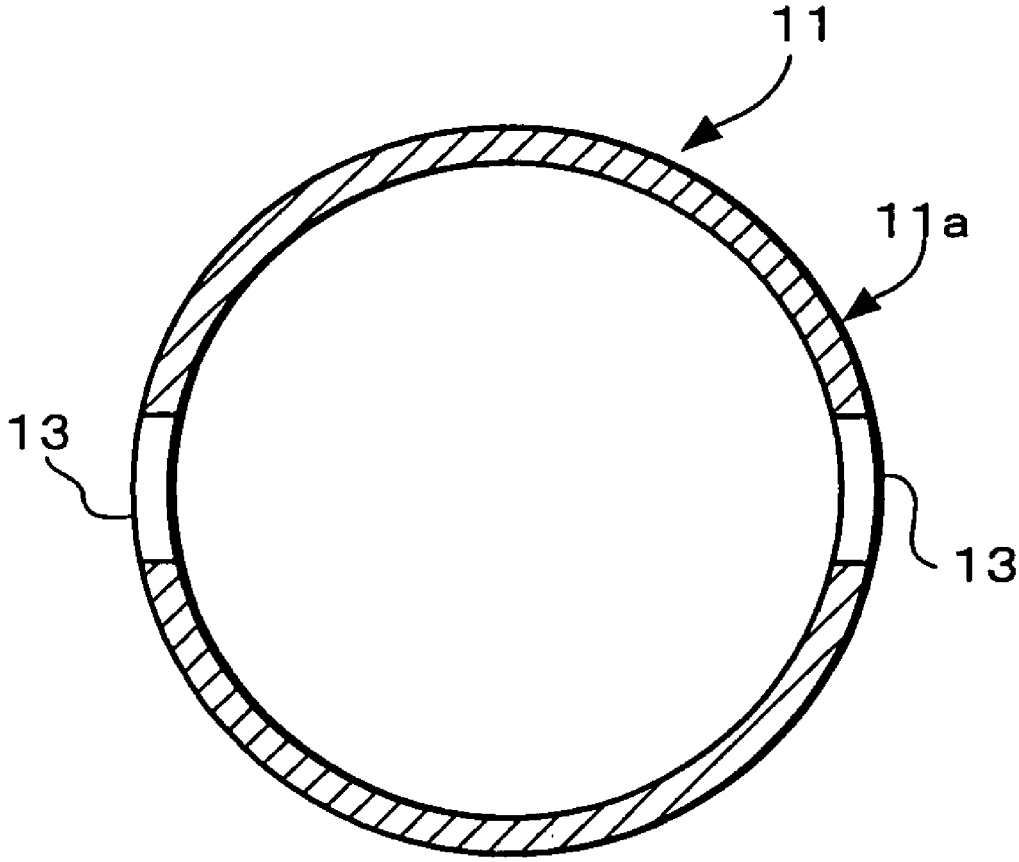

And now, the engagement of the lengthwise sleeve body 11*a* and back end portion 11*b* is explained with reference to FIG. 5. FIG. 5 is a schematic longitudinal sectional view of a rear end portion of the lengthwise sleeve body 11*a*. FIG. 5 shows a schematic longitudinal sectional view of a rear end portion of the lengthwise sleeve body 11*a*. As is clear from FIG. 5, one engaged part 13 (cutting groove) or engaged parts are formed in the connecting end face of the back end portion of the lengthwise sleeve body 11*a*. Therefore, one engaging part (projection) or engaging parts that engage with the engaged part 13 are formed at a connecting end face of the back end portion 11*b*. The elastic member 4 in this embodiment is wound around the sleeve shaft part 14*a* of the driven gear 14 so as to position between outer walls of the first supporting plate 17*a* and back end portion 11*b* which are provided at the upper surface of the upper horizontal plate ha of the fixed member 1.

Figure 6:
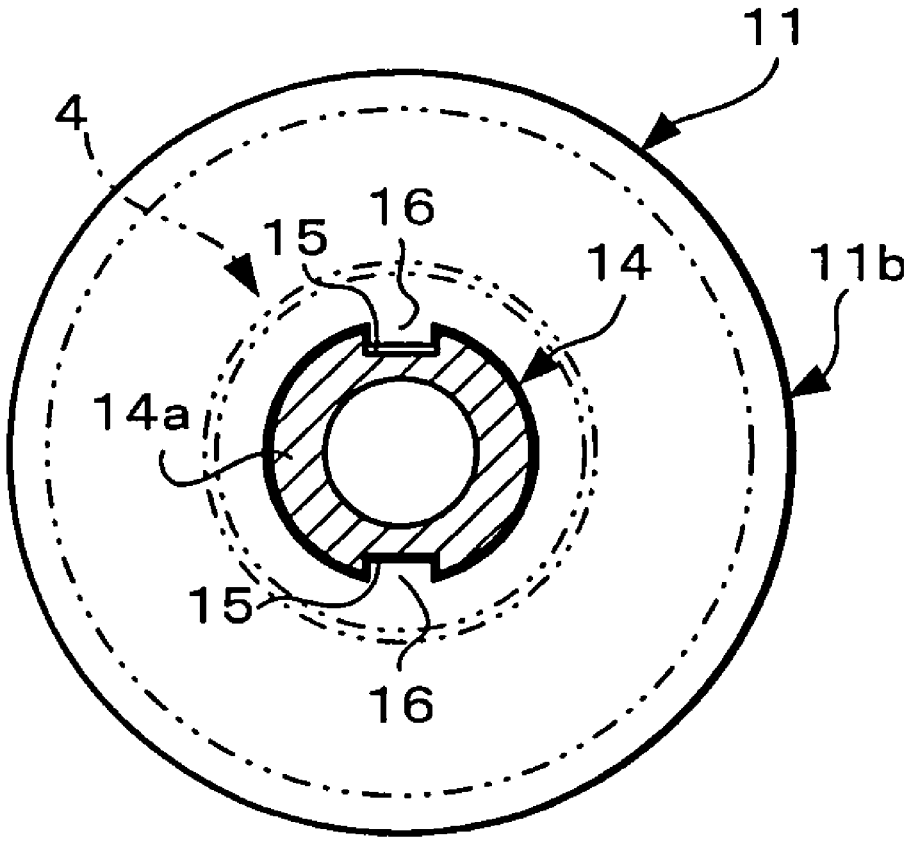
Figure 7:
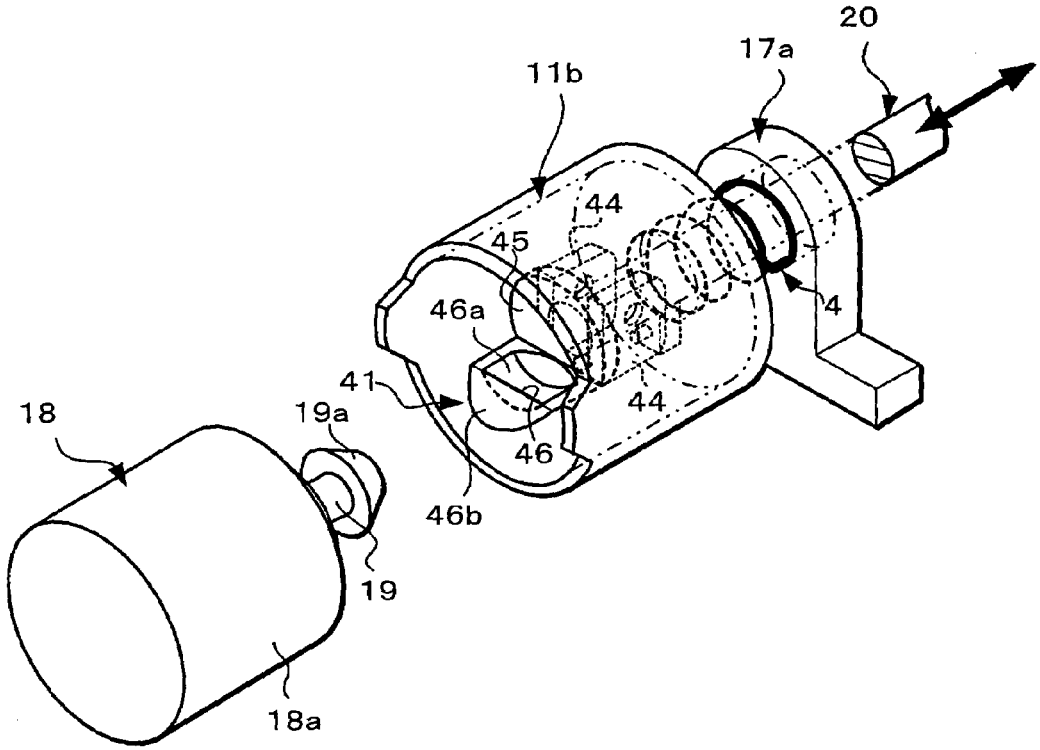
Figure 8:
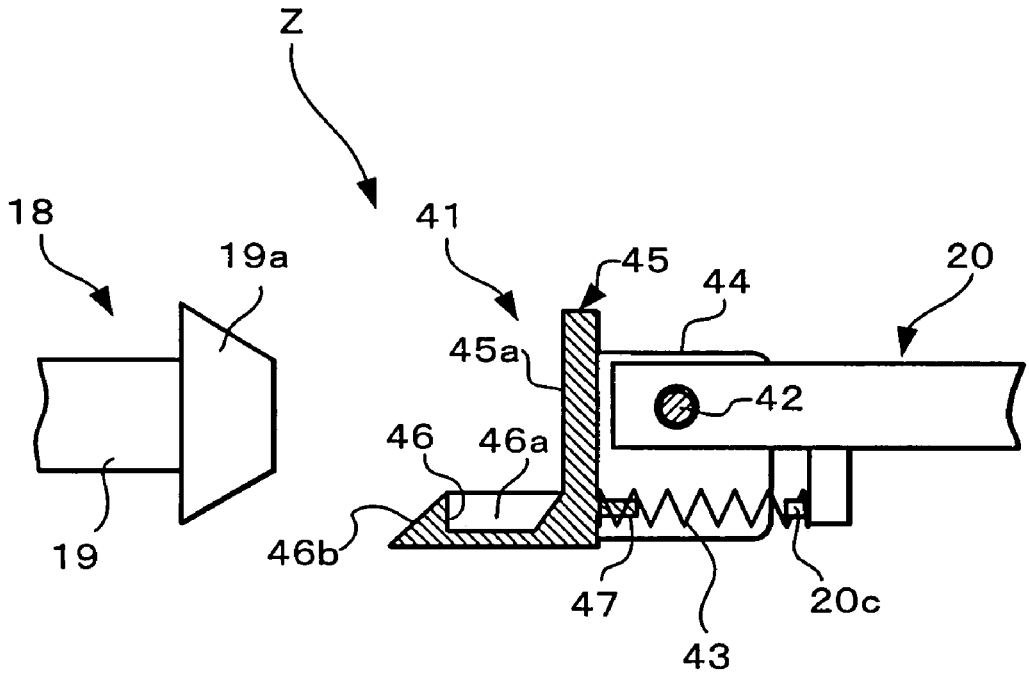

In addition, the engagement of the sleeve shaft part 14*a* of the driven gear 14 and the back end portion 11*b* is explained with reference to FIG. 6. FIG. 6 is a schematic explanation view which assembles the driven gear 14 and inner sleeve 11 integrally. The driven gear 14 has a plurality of caught parts 15 (cutting parts in an axis direction) provided at the outer circumferential wall of the sleeve shaft part 14*a*. Therefore, the back end portion 11*b* includes a plurality of engaging parts 16 (projections) provided at the end portion of the shaft hole, the engaging parts 16 engaging with the caught parts 15.

The driven gear 14 fits the driving operation rod 20 loosely and is arranged between the first supporting plate 17*a* and second supporting plate 17*b* so as to engage with the driving gear 23. The second supporting plate 17*b* is provided at the upper surface of the upper horizontal plate 1*a* of the fixed member 1 so as to face to the first supporting plate 17*a*. When the driving gear 23 provided at the side of the output shaft rotates by the driving force of the drive motor 21, the driven gear 14 and inner sleeve 11 rotate together.

The lower discharge hole 6 is closed during the opening 12 of the inner sleeve 11 passes through the upper suction hole 3. On the other hand, the suction hole 3 is closed during the opening 12 passes through the discharge hole 6.

(4) Detecting Means S1 for Inner Sleeve

The detecting means S1 for the inner sleeve 11 is arranged above the upper horizontal plate 1*a* of the fixed member 1 through the second supporting plate 17*b*. The detecting means S1 detects the rotating position of the inner sleeve 11. The detecting means S1 is applied a principal of a hall IC, a combination of light emitting element and light-sensitive element or the like selectively.

In this embodiment, the plurality of the magnets is fixed to the suitable portions of the outer circumferential wall of the driven gear 14. Additionally, the hall element is used as the detecting means S1 of the fixed member 1.

Therefore, the inner sleeve 11 rotates at 180 degrees by driving force of the drive source 21. When one magnet faces to the detecting means S1, the detecting means S1 picks the flux of N-pole of the magnet and can outputs the revolving position of the inner sleeve 11 to the control part which is not shown in the figure. In addition, the magnet can be replaced from the index. The detecting means S2 has the same condition.

(5) Pushing Operation Body 18

The pushing operation body 18 has the sliding part 18*a* provided a tip portion which is assembled in the inner sleeve 11. When the sliding part 18*a* goes backward to the predetermined position (maximum discharging quantity, for example), the chamber a with the specified content. When the sliding part 18*a* goes forward to the predetermined position, it has a function to push the fluid f in the chamber $\alpha$.

The operation rod in this embodiment is divided by two parts suitably to attach or remove the valve member V to the fixed member 1 easily by way of washing the valve, changing the parts or the like. In other words, one part is the driven operation rod 19 of the pushing operation body 18, composing the valve member V, and another is the driving operation rod 20 provided at the side of the drive source, arranging slidably at the fixed member 1.

And now, the driving operation rod 20 passes through the inner sleeve 11*b*, driven gear 14, supporting plates 17*a*, 17*b* which are arranged at the predetermined position of the fixed member 1 and is defined as a threadable rod body which is formed in the shape of a lengthwise rod.

In addition, the pushing operation body 18 connected to the driving operation rod integrally is provided so as to move forward and backward in the horizontal direction of the drive motor 21 by the driving force of the drive motor 21 (one example) through the clutch 34 of the clutch mechanism Y installed in the fixed member 1. Then, the drive source 21 for the pump X is explained.

(6) Drive Source 21

The drive motor 21 as the drive source is provided horizontally at an aide of the lower surface of the upper horizontal plate 1*a* through the pair of the bearing plates 24, 25. The left bearing plate 24 supports a side of the base portion of the output shaft 22 and is defined as a motor attachment plate. On the other hand, the right bearing plate 25 supports a projected end portion of the output shaft 22. Therefore, the output shaft 22 of the drive motor 21 is supported at a stable condition. The driving gear 23 is fixed to the output shaft 22 of the drive motor 21, engaging with the driven gear 14. The driving gear 23 works with the output shaft 22. In addition, the transmission gear 26 (second driving gear) is fixed to the output shaft 22, facing to the driving gear 23 having a required space L. Therefore, the transmission gear 26 also works with the output shaft 22.

In addition, the screwing body 27 (second driven gear) engages with the transmission gear 26, the screwing body 27 threadably mounted on the screwing rod part 20*a* formed at the driving operation rod 20. Therefore, when the screwing body 27 rotates forward and backward by driving force of the drive motor 21, the pushing operation body 18 moves forward and backward into the inner sleeve 11 through the driving operation rod 20.

The screwing body 27 is sandwiched and supported by the second supporting plate 17*b* which is fixed to the upper surface of the upper horizontal plate 1*a* at the predetermined space and mounting frame 1*c*. The screwing body 27 rotates at a predetermined position at a stable state.

(7) Detecting Means S2 for Pushing Operation Body

The plurality of the detecting means S2 for the pushing operation body 18 are arranged at the case-shaped mounting frame 1*c* to detect the original (starting) position of the pushing operation body 18, forwarding position of the pushing operation body and the like. For example, the detecting means S2 is used the limit switch. In addition, the index or magnet 38 for the detecting means S2 is provided through the engaging part 20*b* of the driving operation rod 20.

(8) Clutch Mechanism Y

And now, the plurality of the engaged parts 23*a*, 26*a* (small hole, small groove) are formed at the facing surface of the driving gear 23 and transmission gear 26. The engaged parts 23*a*, 26*a* engage with the clutch 34 which composes the clutch mechanism Y.

The constructional element of one clutch mechanism Y is explained with reference to FIG. 2. The reference numeral 31 is a driving means (solenoid, for example) for the clutch, providing at the upper surface of the lower horizontal plate 1*b*. The reference numeral 32 is a catching arm which is fixed to the tip portion of the operation rod 32 of the solenoid 31 at a cross state, being directed to the upward direction.

The reference numeral 34 is a clutch which is provided slidably at the output shaft 22 of the drive motor 21 in the axis direction and connects to the driving gear 23 or transmission gear 26 selectively. The clutch 34 in this embodiment is formed in the shape of a block body having an outer appearance of H-shape in section, and a plurality of catching pins 35*a* are formed at another vertical plate 35, engaging with the engaged part 23*a* of the driving gear 23.

On the other hand, the plurality of the catching pins 36*a* are provided at the another vertical plate 36, engaging with the engaged part 26*a* of the transmission gear 26. The upper end portion of the catching arm 33 is positioned between the vertical plates 35, 36.

Therefore, when the operation rod 32 of the solenoid extends, the clutch 34 slides to a direction which closes with the drive motor 21, and the left vertical plate 35 connects to the driving gear 23.

On the other hand, when the operation rod 32 of the solenoid 31 contracts, the clutch 34 slides to a direction which gets away from the drive motor 21, and the right vertical plate 36 connects to the transmission gear 26. Therefore, the driving force of one drive motor 21 makes the inner sleeve 11 of the valve member V to rotate through the clutch mechanism Y and makes the pushing operation body 18 assembled in the inner sleeve 11 to move forward and backward.

(9) Function of Pump

And now, it assumes that the operation rod 32 of the solenoid 31 contracts when the operating means (starting switch) which is not shown in the figure is operated. When the operation rod 32 moves to the right direction as shown in FIG. 32, the clutch 34 also moves to slide to the same direction and connects to the transmission gear 26.

Then, when the drive motor 21 starts (rotates regularly), the pushing operation body 18 goes back to the predetermined position (predetermined value of discharge amount including 200 cc, 300 cc and the like) through the screwing body 27 engaged with the transmission gear 26. Then, one of the detecting means S2 for the pushing operation body 18 detects the back position of the pushing operation body.

When the pushing operation body 18 goes back, the pushing operation body 18 stops at the predetermined position so that it sucks a given amount of fluid f in the inner sleeve.

Figure 2:
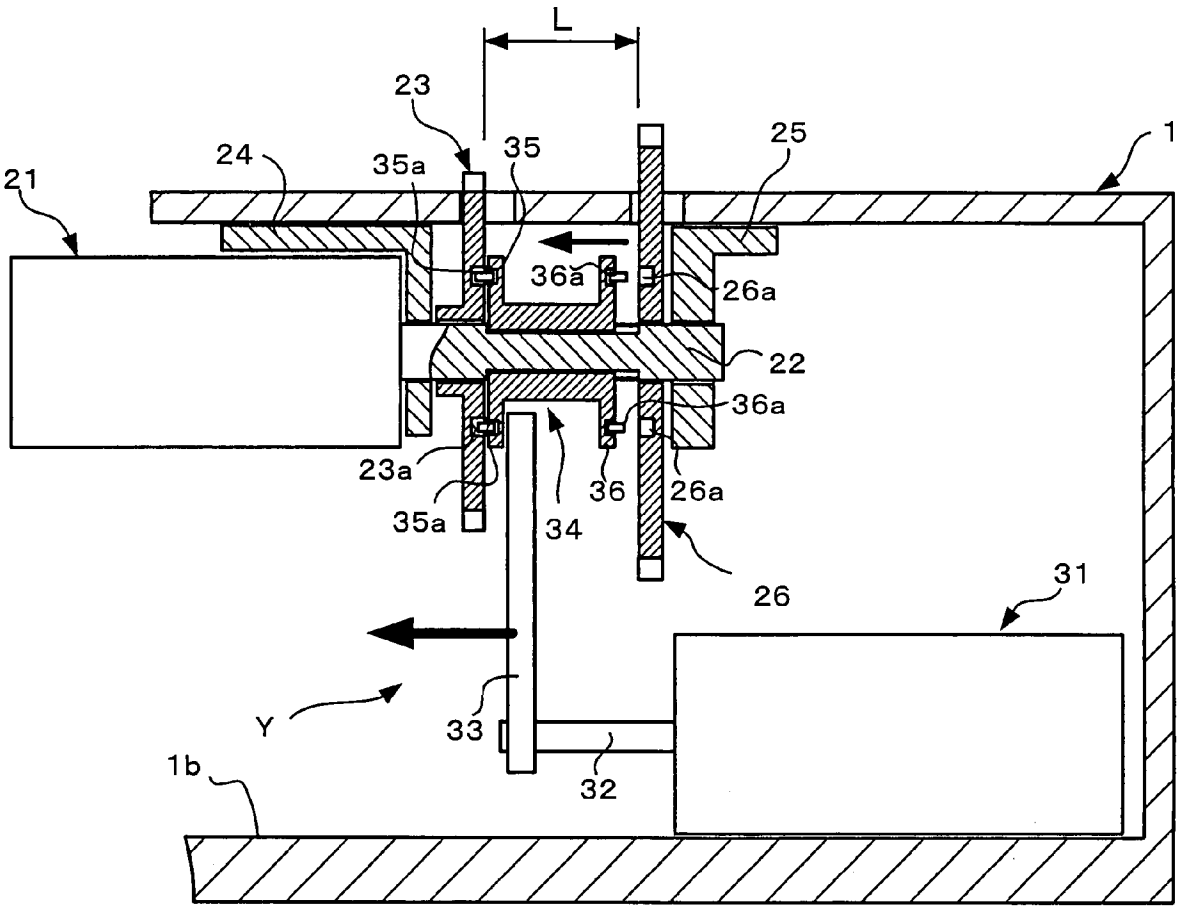
Figure 3:
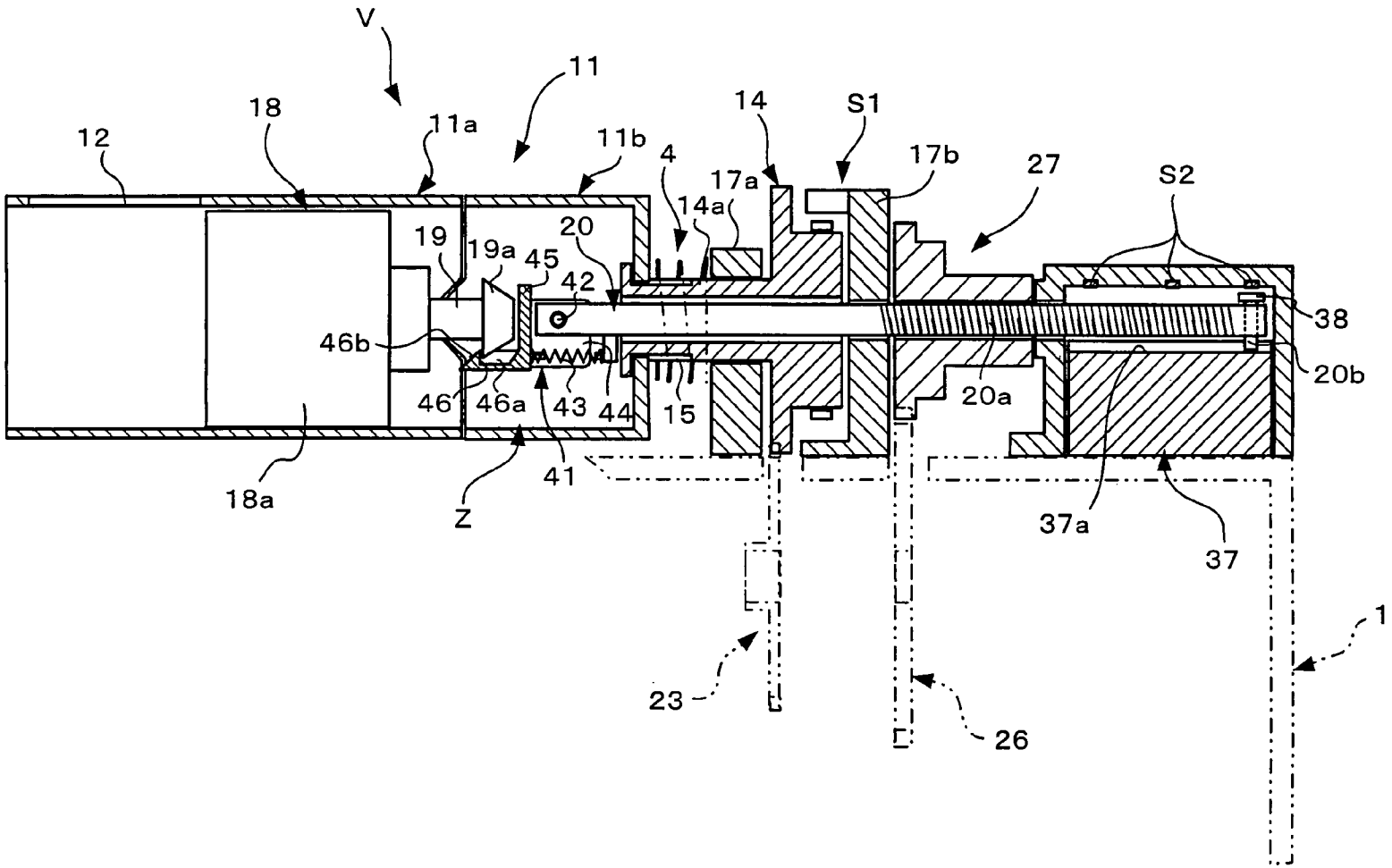
Figure 4:
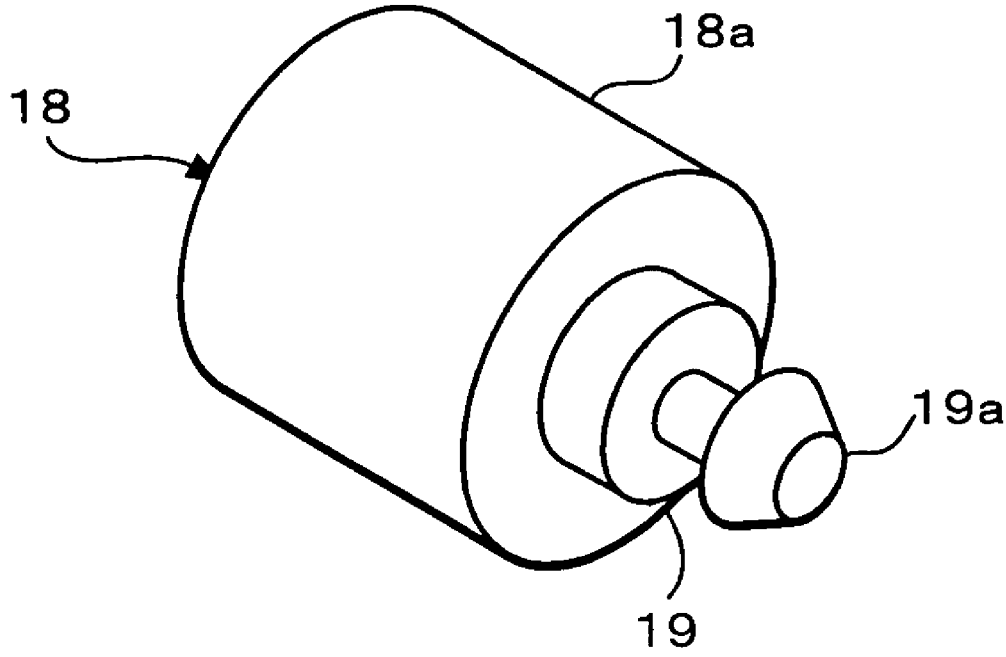

As shown in FIG. 2, the operation rod 32 of the solenoid 31 extends the clutch 34 slides the output shaft 22 to the same direction and connects to the driving gear 23. Then, the catching pin 35*a* of the vertical plate 35 engages with the engaged part 23*a* of the driving gear 23.

When the drive motor 21 starts, the inner sleeve 11 rotates at a specified quantity (180 degrees, for example) through the driven gear 14 engaged with the driving gear 23. The revolving position of the inner sleeve 11 is detected by the detecting means S1. When the inner sleeve 11 rotate at the specified quantity, one opening 12 moves downward and passes through the discharge hole 6 of the outer sleeve 2 (See FIG. 14).

Therefore, fluid f in the inner sleeve 11 starts to drop from the discharge hole 6. Then, the operation rod 32 of the solenoid 31 restores (contracts), and the drive motor 21 can rotate in the reverse direction. Therefore, the pushing operation body 18 goes forward to the predetermined position by the transmission force of the transmission gear 26. Thereby the fixing mixed in fluid f in the inner sleeve 11 is pushed out by the sliding part 18*a* of the pushing operation body 18 (See FIG. 15).

After that, when the operation rod 32 of the solenoid 31 extends, the driving force of the drive motor 21 transmits the driving gear 23 so that the inner sleeve 11 rotates at the specified quantity again.

As stated above, the inner sleeve (inner valve) 11 rotates by the driving force of the drive source 21, takes in fluid f at determinate quantity trough the suction hole 3 from the hopper 5 and discharges through the discharge hole 6. On the other hand, the pushing operation body 18 moves straightly in an axis direction by the driving force of the drive source 21 through the clutch mechanism Y and engageable structure Z of the operation rod. The engageable structure Z of the operation rod is explained here.

(10) Engageable Structure Z of Operation Rod

The engageable structure (hereinafter referred to as engageable structure Z) of the operation rod of the pump with reference to FIGS. 4, 7 and 8 to 12. It provides a simple explanation about the engageable structure Z in the present invention that it has the connecting structure with the driven operation rod 19 of the valve member V which can remove from the fixed member 1 and the driving operation rod 20 provided at the side of the drive source 21 which is arranged at the fixed member 1 integrally. In this embodiment, the valve member V is connected to the driving operation rod 20 of the fixed member 1 so as to remove the valve member V from the fixed member 1. The valve member V is connected to the driving operation rod 20 and removes from the driving operation rod 20 because it is easy to take apart the member composed the valve member V. Therefore, it can wash the constructional elements.

And now, since the valve member V of the present invention is suitable for the supply device (see the reference document) of the soup and the like, the supply device developing by the applicant (or inventor) in his own right, the engageable structure Z includes the constructional element as follows:

(a) The valve member V is comprised of the outer sleeve 2 as the outer valve having the suction hole 3 and discharge hole 6; the inner sleeve as the inner valve installed into the outer sleeve 2 rotatably; and the pushing operation body 18 having the driven operation rod 19 and having the sliding part 18*a* which installed in the inner sleeve 11.

(b) For the drive source, it is comprised of the electric drive source 21 and the driving operation rod 20 which moves horizontally by the force of the drive source 21 and introducing by the supporting member 17*a*, 17*b* and 37.

(c) When the driven operation rod 19 of the pushing operation body 18 connects to the driving operation rod 20 of the side of the drive source, the catching part 19*a* of the driving operation rod 20 of the valve member V engages with the connection-supporting device 41 which is provided at the tip portion of the driving operation rod 20 through the horizontal shaft 42.

(d) The connection-supporting device 41 is supported pivotably at a cantilevered state to the driving operation rod 20 at a biasing state by the spring member 43 in the specified direction.

Figure 10:
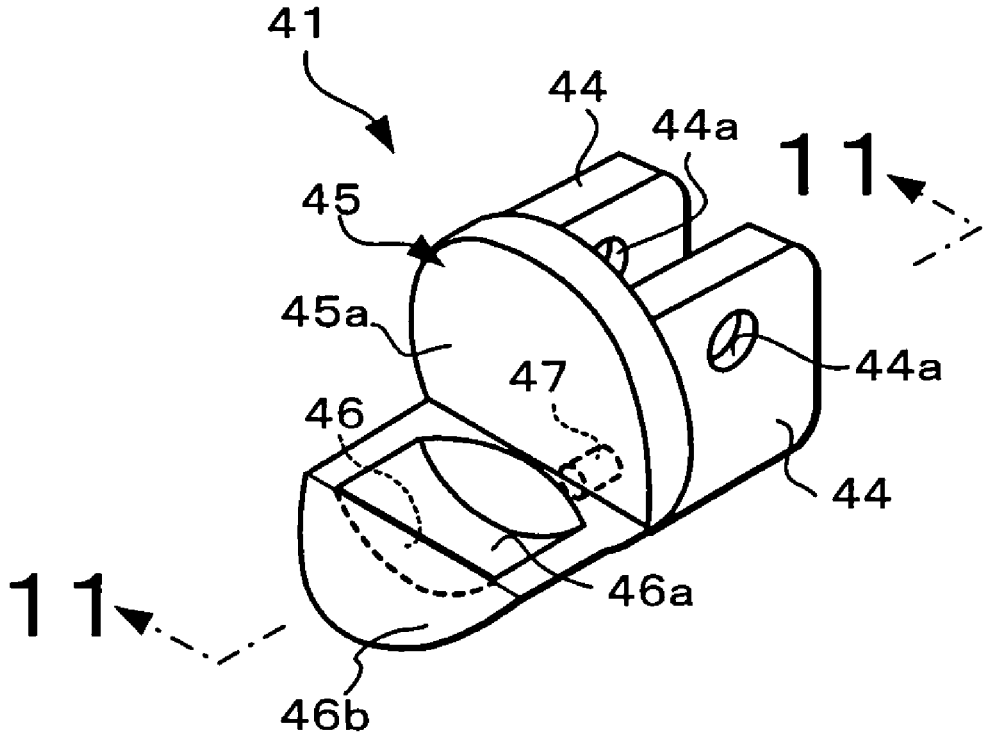
Figure 11:
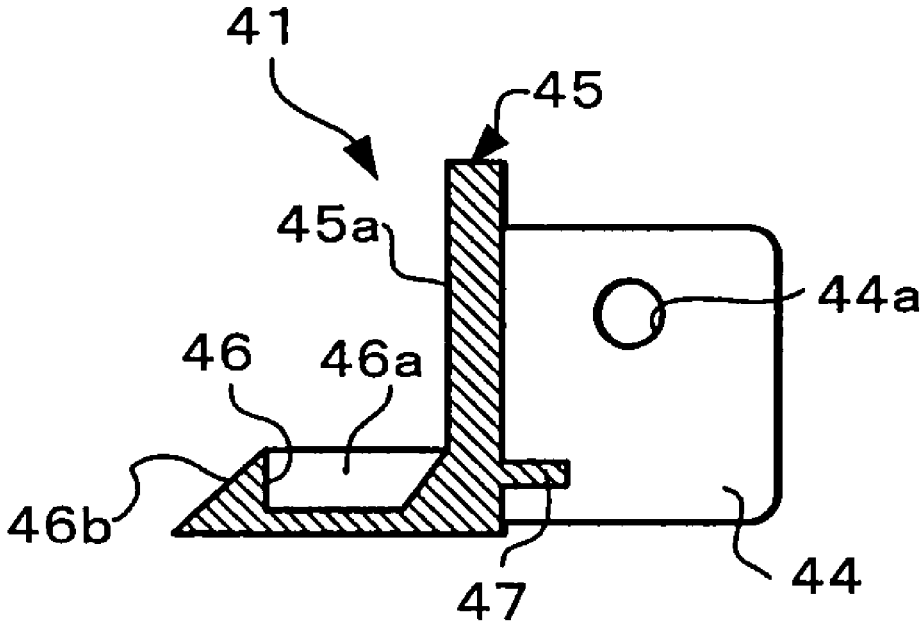

(e) For the specific structure of the connection-supporting device 41, as shown in FIGS. 10 and 11, it is comprised of a pair of pivoted plates 44 for attachment having a pair of shaft holes 44*a* for the horizontal shaft 42 provided at the upper end portion thereof; a vertical plate 45 which is formed in the shape of a round, installing consecutively in the tip end portion of the pivoted plates 44; and a locking part 46 installed consecutively in the lower end portion at the front surface of the vertical plate 45 at a projecting state, forming in the shape of a saucer.

Figure 9:
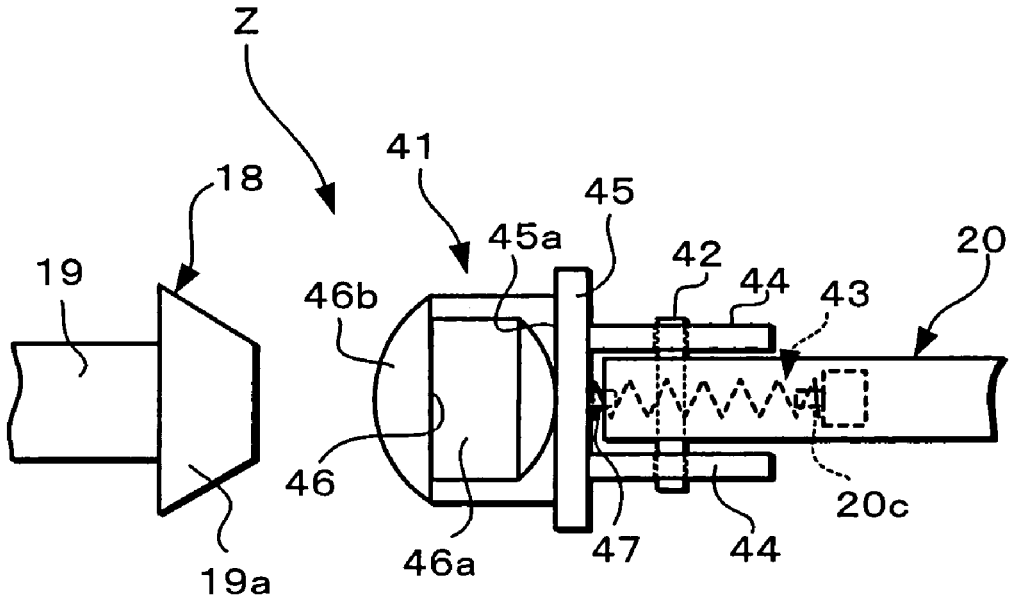

(f) For the constructional elements of the connection-supporting device 41, making of metal or hard resin, the vertical pivoted plates 44 are formed at the right and left walls of the tip portions of the driving operation rod 20, forming of the suitable size and shape. In addition, the vertical plate 45 has a vertical pressure face 45*a* so as to bring out the pressure function to the tip surface of the driven operation rod 19. In addition, the catching concave part 46*a* is formed on the upper surface of the locking part 46, engaging the catching part 19*a* of the driven operation rod 19, the catching part 19*a* being formed in the shape of a trapezoid including a balled trapezoid, coning trapezoid and the like. A taper 46*b* is formed at the tip portion of the catching concave part 46*a*, the taper 46*b* sliding to the catching part 19*a* when in connecting. In addition, as shown in FIG. 9, a projected spring-supporting part 47 is provided at the lower end portion of the inner surface of the vertical plate 45. In addition, the inner surface of the vertical plate 45 contacts the upper portion of the tip portion of the driving operation rod 18.

(g) Furthermore, the horizontal shaft 42 the supports connection-supporting device 41 pivotably is positioned at the upper end portion of the pivoted plate for attachment, and the spring member 43 biases the connection-supporting device 41 to the position at the horizontal state is positioned at a side of the bottom part of the connection-supporting device. In addition, one end of the spring member 43 is supported by the spring-supporting part 47 of the connection-supporting device 41, and another end of the driving operation rod 20 is attached to a spring-end supporting part 20*c* which projects from the bottom surface of the tip portion thereof.

(11) Function

Figure 12:
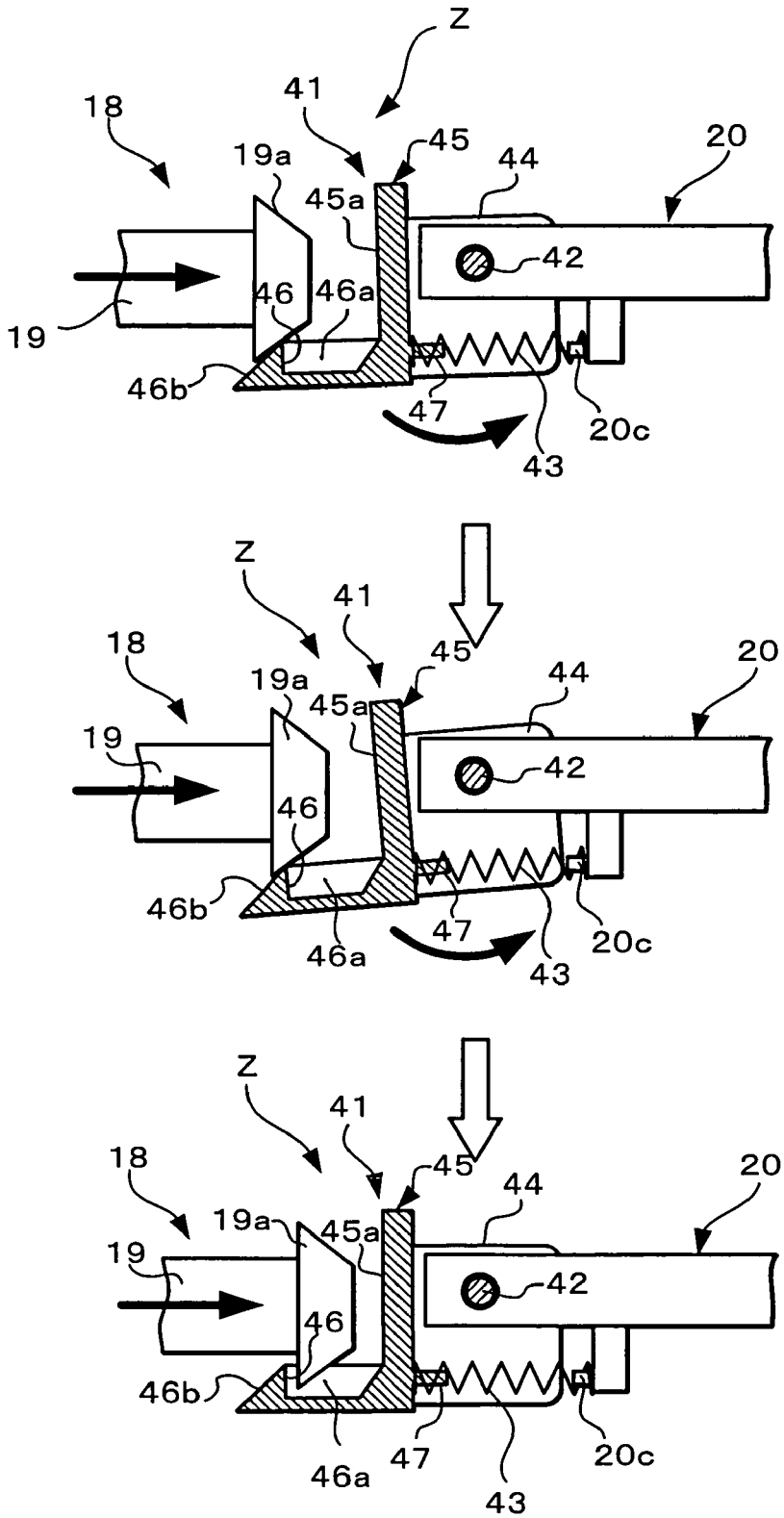

As shown in FIG. 12, for connecting the valve member V, the connection-supporting device 41 is pressed to the taper of the catching part 19*a* of the driven operation rod 19 in the valve member V and rotates at the point of support of the horizontal shaft 42 in a direction that the locking part 46 comes down when the valve member V is pushed to the taper 46*b* of the locking part 46 of the connection-supporting device 41. In addition, when the catching part 19*a* of the driven operation rod 19 goes over the taper 46*b* of the connection-supporting device 41, the connection-supporting device 41 comes back by force of the spring member 43. As a result, the catching part 19*a* of the valve member V is locked by the locking part 46 of the connection-supporting device 41 automatically.

Figure 13:
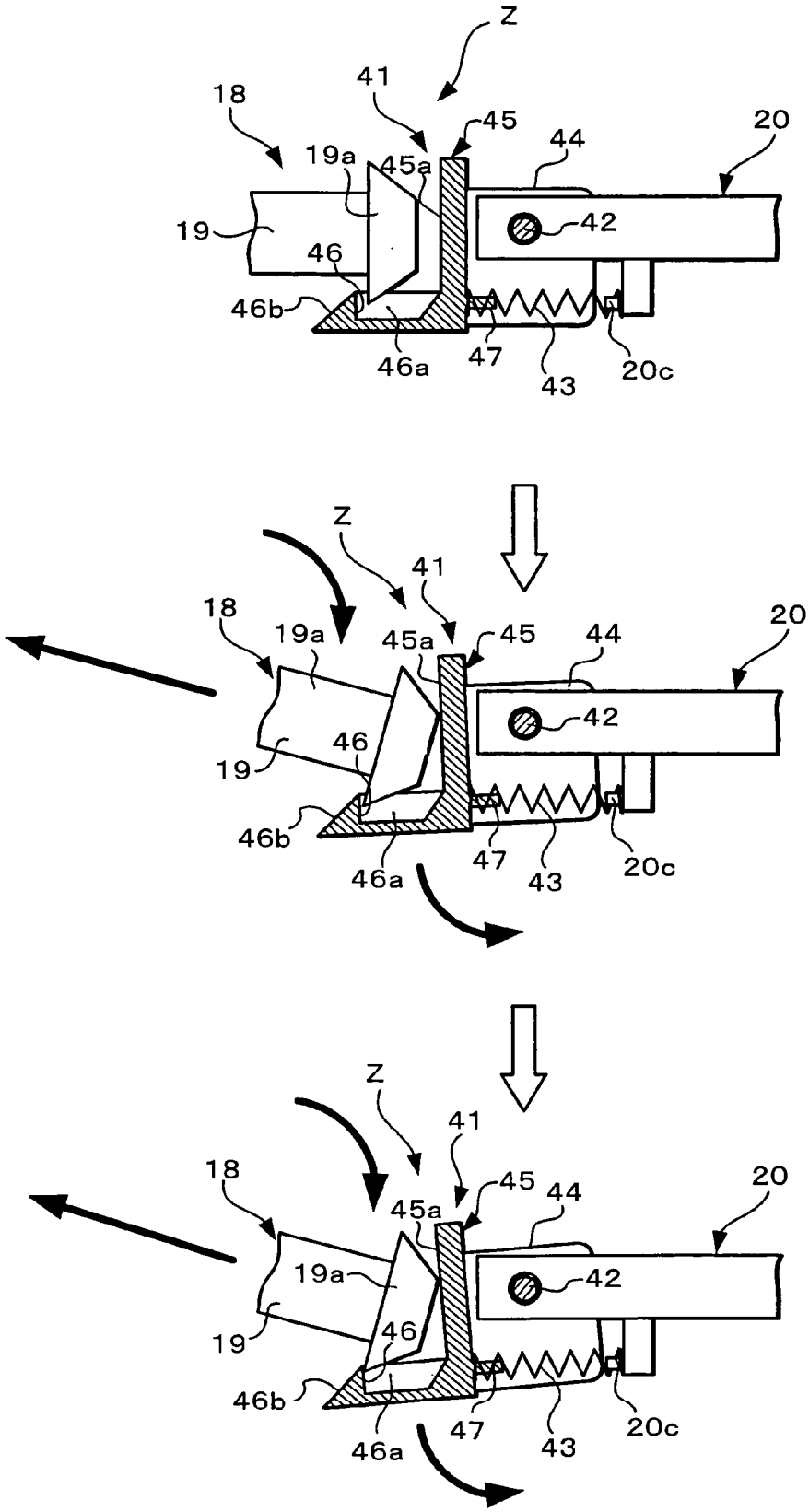
Figure 14:
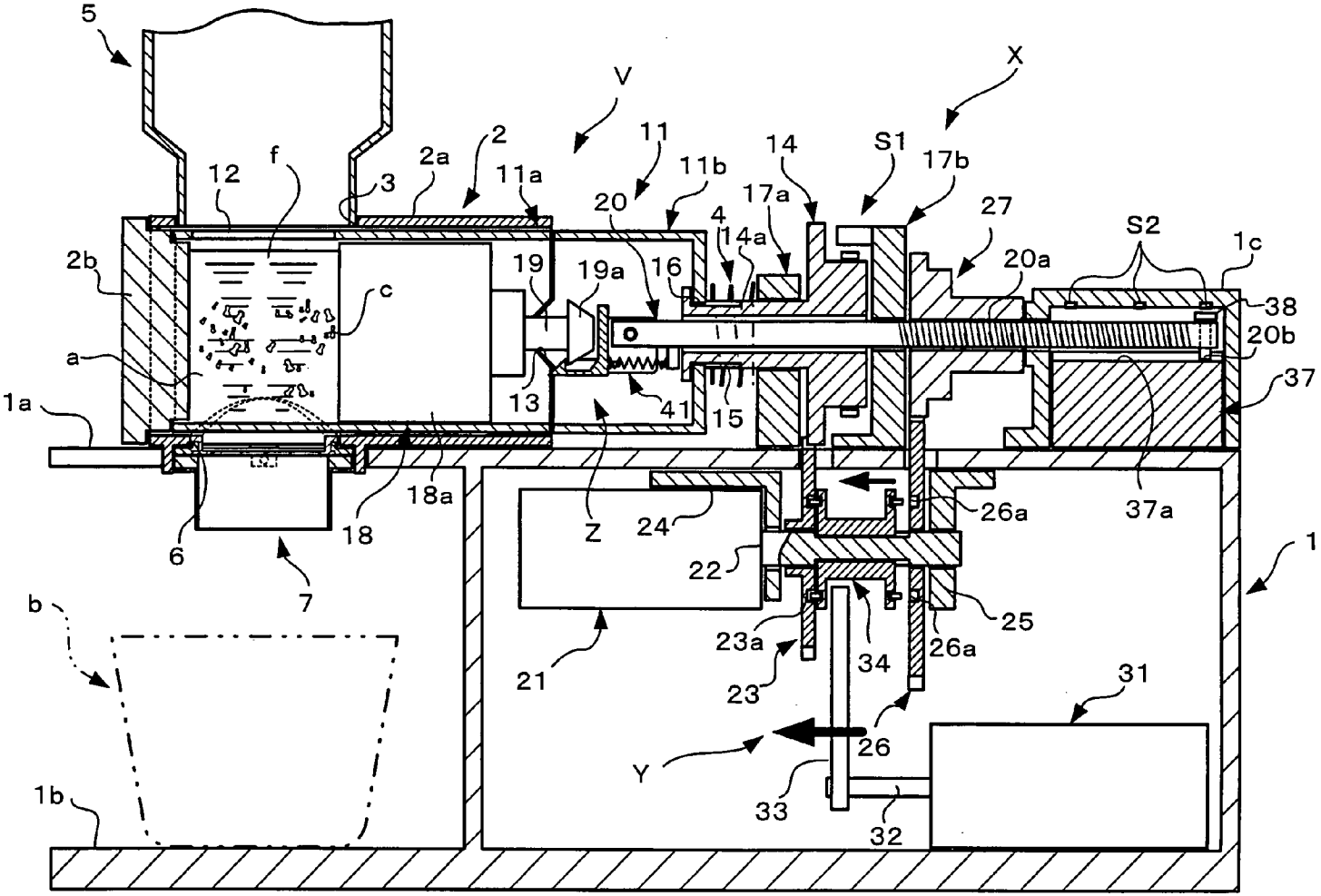
Figure 15:
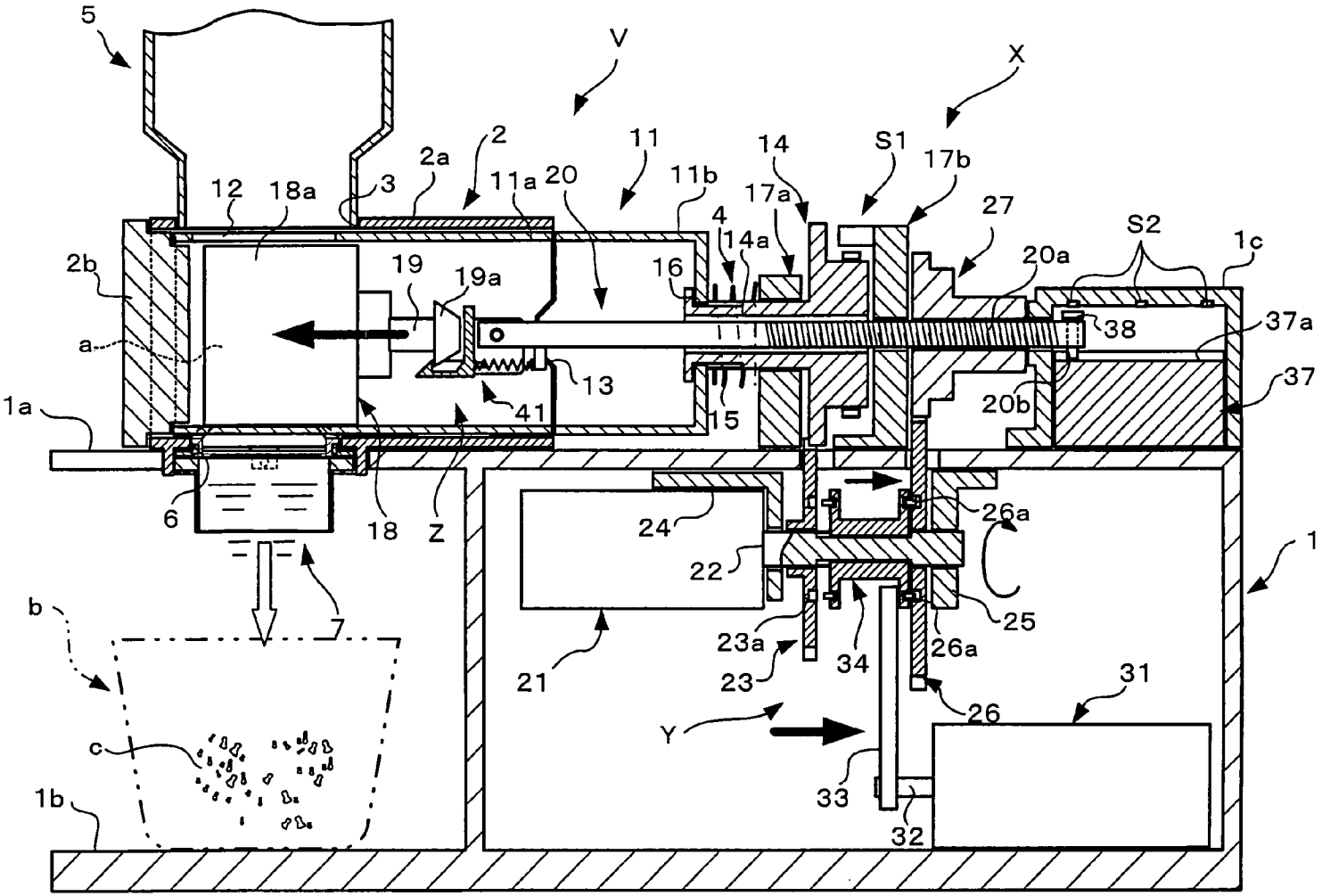

On the other hand, as shown in FIG. 13, when the valve member V is removed and the valve member V is brought up, the engagement of the valve member V and connection-supporting device 41 can be broken up easily since the upper end of the vertical plate 45 of the connection-supporting device 41 is supported by the upper portion of the tip end surface of the driving operation rod 20 or the locking part 46 is formed in the shape of the dish. In addition, in this case, the connection-supporting device 41 may be pushed down by the finger without bringing up the tip portion of the valve member V.

EXAMPLE

In this embodiment, the catching concave part 46*a* which engages the catching part 19*a* of the driven operation rod 19 is formed at the upper surface of the locking part 46 of the connection-supporting device 41, and the catching concave part may be defined by an engagement hole. In addition, one drive source of the pump is used in this embodiment, and two drive sources may be used. The number and shape of the drive source (driving force of the drive motor, operating method of the operating handle) is not the limited elements in the present invention.

Figure 16:
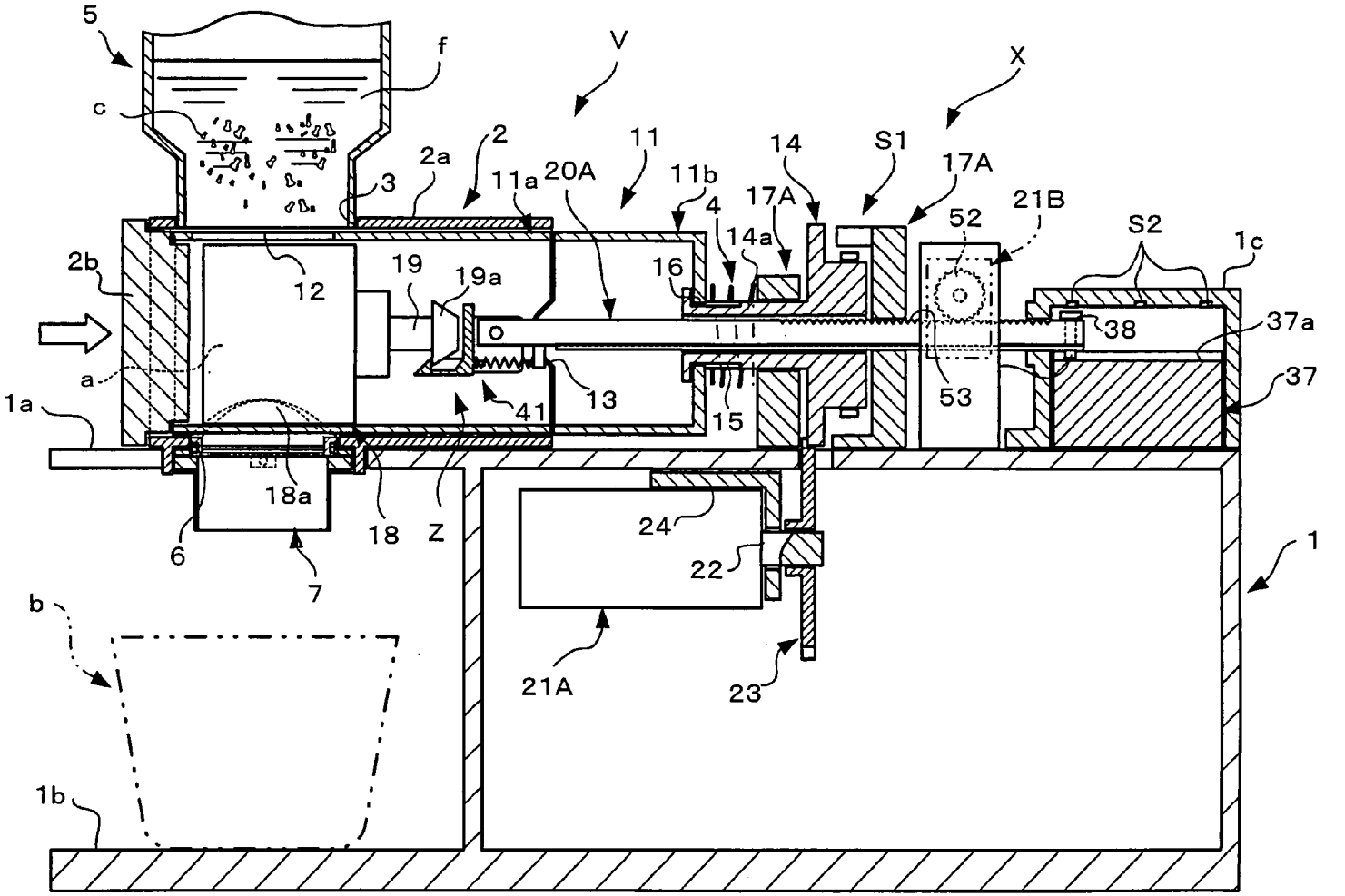
FIGS. 16 to 18 are explanation views of a drive source and driving operation rod.
Figure 17:
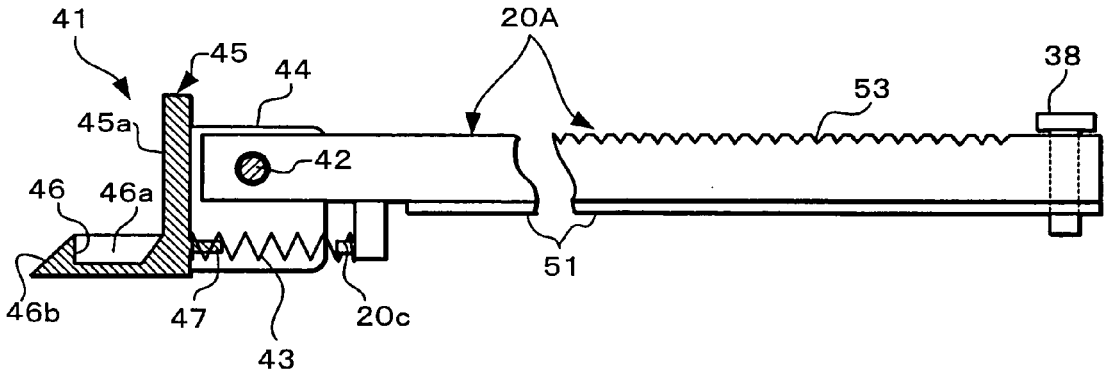
Figure 18:
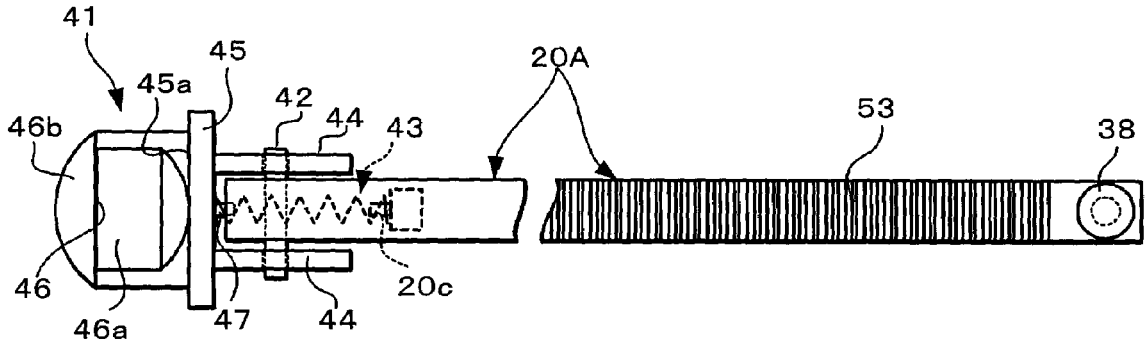

The second embodiment of the present invention is described referring to FIGS. 16 to 18. In addition, through the drawings of the embodiments, like components are denoted by like numerals as of the first embodiment and will not be further explained in great detail.

For the drive source in the second embodiment, the first drive motor 21A to rotate the inner sleeve 11 of the valve member V and second drive motor 21B to make the pushing operation body 18 to move forward and backward are arranged separately and drive independently. In this way, two drive sources are disclosed in the reference documents (Unexamined patent publication No. 2000-226100, unexamined patent publication No. 2002-112742 and the like).

Therefore, the driving force of the second drive motor 21B for the pushing operation body 18 transmits the driving operation rod 20A guided by one supporting member 17A or plurality of the supporting members 17A which are fixed to the upper horizontal plate 1*a* of the fixed member 1. The driving operation rod 20A has a sliding plate 51 guided to the supporting member 17A, providing at the side of the bottom surface thereof and has a rack 53 engaged with a pinion 52 which is fixed to the revolving shaft of the drive motor 21B, providing at the upper surface thereof. The connection-supporting device 41 has the same structure in the first embodiment.

In addition, when the drive source is defined by an operating handle which is not shown, the driving means is comprised of a revolving disc provided at the operating handle and a catching arm which extends from the outer circumferential part of the revolving disc radially and engages with the operation rod of the pushing operation body 18.

Furthermore, for the example of the embodiments, the fluid f is defined as the soup with fixings, and it is not limited in the present invention. The fluid f including processed foods, paints, various materials and the like put in the hopper 5. For example, the processed foods include a bean juice, tomato catsup, mayonnaise, various soups, ice creams and the like. The paints include the dry paints, outdoor paints and the like. The materials include creams for makeup, toothpaste and the like. In addition, the letter of "b" indicates the glasses, and the letter "c" is defined as the fixings in FIG. 1.

As set forth above, the advantages of the invention are as follows:

(1) The invention disclosed in claims 1, 2 and 3 can remove the valve member from the driving operation rod easily. In particular, the valve member is removed from the driving operation rod by only bringing the valve member up with both or single hand or pushing the connection-supporting device down with a hand.

(2) For the invention disclosed in claim 2, the connection-supporting device has a reasonable structure so that the engageable structure of the operation rod can be simplified. In particular, since only one connection-supporting device and spring member are used, it is easy to manufacture and assemble. Therefore, it can reduce the cost.

(3) For the invention disclosed in claim 3, it is easy to engage the valve member.

(4) For the invention disclosed in claim 4, the connection-supporting device rotates smoothly.

(5) For the invention disclosed in claim 5, the valve member can be removed from the fixed member. In addition, it eliminates damage. Furthermore, it can improve the design.

(6) For the invention disclosed in claim 7, since the driving force of the one drive motor 21 is used for moving the pushing operation body forward and backward and for rotating the inner sleeve, and it can reduce the number of the drive motor, as a result, it can reduce the cost of the pump. The pump with new engageable structure of the operation rod, suitable for the soup with fixings or various fluids, can be proposed.

What is claimed is:

1. A coupling structure of an operation rod in a pump comprising, a valve assembly having an outer sleeve as an outer valve, an inner sleeve as an inner valve rotatably installed in said outer sleeve, a pushing operation body including a sliding part installed in said inner sleeve and including a driven operation rod; a drive source; a driving operation rod driven by said drive source to move axially, said drive source including a support member guiding said driving operation rod; and a catching part of said valve assembly which engages with a connection-supporting device which is attached to said driving operation rod when said driven operation rod of said valve assembly and said driving operation rod of said drive source are connected, means pivotally mounting said connection-supporting device in a cantilevered state on said driving operation rod, a spring member biasing said connection-supporting device in a specified direction, said connection-supporting device including a vertical plate installed at a tip end portion of a pivoted plate for attachment and a locking part installed in a front surface of said vertical plate and projecting therefrom.

2. The engageable structure of an operation rod in a pump according to claim 1, further comprising:

a catching concave part formed at an upper surface of said locking part of said connection-supporting device and engaging a catching part of said driven operation rod.

3. The engageable structure of an operation rod in a pump according to claim 1, wherein said valve assembly is guided by a taper of said locking part of said connection-supporting device when said valve assembly is being connected, and wherein when said valve assembly is lifted, the engagement of said valve assembly and connection-supporting device can be broken up when the valve assembly is removed.

4. The engageable structure of an operation rod in a pump according to claim 1, wherein said connection-supporting device is supported pivotably by a horizontal shaft, said horizontal shaft positioned at an upper end portion of said pivoted plate for attachment, and said spring member biasing said connection-supporting device to a position of a horizontal state is positioned at a lower side of said connection-supporting device.

5. The engageable structure of an operation rod in a pump according to claim 1, wherein said inner sleeve includes a longitudinal sleeve body and a back end portion thereof engaging with said longitudinal sleeve body and enclosing said connection-supporting device, said back end portion being biased in a direction which engages with a back end portion of said longitudinal sleeve body by an elastic member.

6. The engageable structure of an operation rod in a pump according to claim 1, wherein said drive source is a drive motor or an operating handle.

7. The pump having said engageable structure of said operation rod according to claim 1, wherein said drive source is one device including a clutch mechanism which is operable to switch said drive source for rotating said inner sleeve and for moving said pushing operation body forward and backward.

8. The pump having said engageable structure of said operation rod according to claim 1, wherein said drive source comprises two devices, one operable to rotate said inner sleeve through a plurality of gears, and another operable to move said pushing operation body forward and backward through a pinion and a rack.

* * * * *

UNITED STATES PATENT AND TRADEMARK OFFICE

CERTIFICATE OF CORRECTION

PATENT NO. : 7,611,336 B2
APPLICATION NO. : 11/346217
DATED : November 3, 2009
INVENTOR(S) : Kazumasa Ikuta It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 945 days.

Signed and Sealed this

Twelfth Day of October, 2010

David J. Kappos

David J. Kappos
*Director of the United States Patent and Trademark Office*